US006244079B1

(12) United States Patent
Bae

(10) Patent No.: US 6,244,079 B1
(45) Date of Patent: Jun. 12, 2001

(54) BRAKE ASSEMBLY OF A WASHING MACHINE

(75) Inventor: Sang Chul Bae, Seoul (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/234,710

(22) Filed: Jan. 21, 1999

(30) Foreign Application Priority Data

May 12, 1998 (KR) ..... 10-16949
May 12, 1998 (KR) ..... 10-16951

(51) Int. Cl.[7] ..... D06F 37/42
(52) U.S. Cl. ..... 68/23.7; 68/133
(58) Field of Search ..... 68/23 R, 133, 68/131, 23.7, 134

(56) References Cited

U.S. PATENT DOCUMENTS 4,724,688 * 2/1988 Shikamori et al. ..... 68/23.7
4,732,016 * 3/1988 Hirooka et al. .
4,802,347 * 2/1989 Nystuen .
4,835,994 * 6/1989 Ishida et al. .
4,953,369 * 9/1990 Ito .
5,131,509 * 7/1992 Moon et al. .
5,379,616 * 1/1995 Bae .
5,862,685 * 1/1999 Lim .

* cited by examiner

*Primary Examiner*—Frankie L. Stinson
(74) *Attorney, Agent, or Firm*—Burns, Doane, Swecker & Mathis, L.L.P.

(57) ABSTRACT

A brake assembly of a washing machine is comprised of a brake drum rotating together with a spin basket, a brake band disposed on an outer side of the brake drum, and a brake lever for driving the brake band. A brake spring elastically pushes the brake lever so that the brake band is contacted with the brake drum. A brake link is installed on the brake lever so as to be capable of pivoting. A link spring elastically pushes the brake link in a pivoting direction thereof. A bolt is screwed to the brake lever. The screwed end of the bolt is contacted with the brake link against an elastic force of the link spring, and the relative pivoting position of the brake link with respect to the brake lever is adjusted according to a screwed position of the bolt. Thus, the error of the braking operation caused by the assembly tolerance of the brake assembly or the abrasion of the brake band can be amended.

4 Claims, 5 Drawing Sheets

BRAKE ASSEMBLY OF A WASHING MACHINE

This application claims priority under 35 U.S.C. §§119 and/or 365 to Patent Application No. 98-16949 filed in Korea on May 12, 1998; and Patent Application No. 98-16951 filed in Korea on May 12, 1998; the entire content of which is hereby incorporated by reference.

BACKGROUND OF THE INVENTION

1. Field of the Invention

The present invention relates to a brake assembly for use in a washing machine, and more particularly, to a brake assembly of a washing machine capable of amending an error of a braking operation caused by an assembly tolerance and/or an abrasion of a brake band.

2. Prior Art

FIG. 6 is a partial sectional view of a conventional washing machine, which shows a pulsator, a shaft assembly, and a driving motor, and FIG. 7 is a partial enlarged transverse sectional view of FIG. 6, which shows a brake assembly.

A washing machine has an outer tub 101 suspended in a casing, a spin basket 103 rotatably installed in the outer tub 101, and a pulsator 105 installed in the spin basket 103. A driving motor 107 is installed under the outer tub 101. Between the outer tub 101 and the driving motor 107, a shaft assembly 109 for transmitting the driving force of the driving motor 107 to the pulsator 105 and the spin basket 103, and a clutch assembly 111 for controlling the transmission of the driving force of the driving motor 107 to the shaft assembly 109 is installed.

The clutch assembly 111 is comprised of a lower clutch 115 into which a motor shaft 113 is inserted by force, an upper clutch 117 engaged with, or disengaged from, the lower clutch 115, and a clutch guide device 119 for engaging the upper clutch 117 with, or disengaging the upper clutch 117 from the lower clutch 115, by moving the upper clutch 117 along the motor shaft 113.

The shaft assembly 109 is comprised of a hollow spin basket shaft 139 connected with the spin basket 103, a pulsator shaft 137 disposed in the spin basket shaft 139 coaxially therewith and connected to the pulsator 105, a gear assembly 141 for reducing the rotational velocity of the driving motor 107 and transmitting it to the pulsator 105 during a washing operation or a rinsing operation, an outer casing 142 for encompassing them, and a brake assembly 143 for controlling the rotation of the spin basket shaft 139. The outer casing 142 is comprised of an upper casing 147 and a lower casing 149.

The brake assembly 143 is comprised of a cylindrical brake drum 155 surrounding the outer area of the gear assembly 141, a brake band 165 installed on an outer side of the brake drum 155 so as to control the rotation of the brake drum 155, and a brake lever 133 for operating the brake band 165 so as to be contacted with, or distanced from, the periphery of the brake drum 155.

A brake lever shaft 167 in parallel with the rotational axis of the brake drum 155 is installed on the brake lever 133, and a brake link 169 is installed on the end of the brake lever 133. A brake spring 171 for applying an elastic force to the brake lever 133 is installed on the brake lever shaft 167.

During the washing and rinsing operations, the brake lever 133 pulls the brake band 165 with the elastic force of the brake spring 171, and thereby the brake band 165 is contacted with the brake drum 155. Therefore, the rotation of the brake drum 155 is braked by the brake band 165. In this situation, the upper clutch 117 is disengaged from the lower clutch 115.

As the driving motor 107 operates to rotate the motor shaft 113, the rotational velocity of the motor shaft 113 is reduced by the gear assembly 141 and is then transmitted to the pulsator shaft 137. The pulsator 105 is rotated by the rotation of the pulsator shaft 137, whereby a vortex water-flow is generated in the spin basket 103, and thereby, the washing and rinsing operations are performed.

During a dehydrating operation, the brake lever 133 is pulled out by a drain motor (not shown), and thereby the brake lever 133 pivots about the brake lever shaft 167. Then, the brake band 165 is distanced from the brake drum 155, and the brake drum 155 lies in a rotatable state. In this situation, the upper clutch 117 is moved down by the operation of the clutch guide device 119, so as to be engaged with the lower clutch 115.

As the driving motor 107 operates to rotate the motor shaft 113, the upper clutch 117 engaged with the lower clutch 115 is rotated, and thereby, all of the brake drum 155, the spin basket shaft 139, and the pulsator shaft 137 are rotated. Therefore, the pulsator 105 and the spin basket 103 are rotated at the same speed as the rotational speed of the motor shaft 113, and the laundry accommodated in the spin basket 103 is dehydrated by the centrifugal force generated in such a situation.

When the dehydrating operation ends, the driving motor 107 stops operating, and the brake lever 133 is returned to the original state by the brake spring 171. Thus, the brake drum 155 is braked again by the brake band 165. Furthermore, the upper clutch 117 is moved upward by the operation of the clutch guide device 119 so as to be disengaged from the lower clutch 115.

However, in such a conventional washing machine, due to the assembly tolerance occurring while components of the brake assembly 143 are being assembled, the brake band 165 may not release the brake drum 155 properly when the brake lever 133 is driven by the drain motor. More specifically, due to the assembly tolerance, the brake lever 133 cannot be pulled out sufficiently even when the drain motor normally pulls the brake lever 133, and in such a situation, the brake lever 133 is pivoted insufficiently. Therefore, the brake band 165 may remain contacted with the brake drum 155, or the brake drum 155 may not be released normally.

Furthermore, even when the position of the brake lever 133 is changed by the abrasion of the brake band 165, the brake lever 133 cannot be sufficiently pivoted by the drain motor, for which the brake drum 155 may not be released properly.

Meanwhile, since the brake spring 171 for elastically pushing the brake lever 133 is disposed between the brake lever 133 and the upper casing 147 of the shaft assembly 109, the size of the shaft assembly 109 increases as much as the height of the brake spring 171. Moreover, since one end of the brake spring 171 should be supported by the outer casing 142 of the shaft assembly 109 and the other end thereof should be supported by the brake lever 133, it is not easy to assemble them.

SUMMARY OF THE INVENTION

The present invention has been proposed to overcome the above-described problems in the prior art, and accordingly, it is the object of the present invention to provide a brake assembly of a washing machine capable of amending an error of a braking operation caused by an assembly tolerance occurring when the components thereof are assembled or by an abrasion of a brake band.

Another object of the present invention is to provide a brake assembly which is capable of reducing the size of a shaft assembly, and which is easy to be manufactured.

To achieve the above object, the present invention provides a brake assembly of a washing machine, comprising: a brake drum rotating together with a spin basket; a brake band disposed on an outer side of the brake drum; a brake lever of which one end is fixed to the brake band, the brake lever for driving the brake band so that the brake band is contacted with or distanced from the brake drum according to a pivoting position thereof; a brake spring for elastically pushing the brake lever in a pivoting direction thereof; a brake link installed on the other end of the brake lever so as to be capable of pivoting about a pivoting axis in parallel with a pivoting axis of the brake lever; and a means for adjusting a relative pivoting position of the brake link with respect to the brake lever.

Preferably, the adjusting means comprises a link spring for elastically pushing the brake link in a pivoting direction thereof; and a bolt screwed to the brake lever so that a screwed end thereof is contacted with the brake link against an elastic force of the link spring, the bolt for adjusting a relative pivoting position of the brake link with respect to the brake lever according to a screwed position thereof.

Preferably, a nut is disposed between the bolt and the brake lever. The nut prevents the bolt from being released.

Even when an assembly tolerance or an abrasion of the brake band occurs, the error of the braking operation can be amended easily by adjusting the bolt, and therefore, the brake assembly can operate in a stable manner.

BRIEF DESCRIPTION OF THE DRAWINGS

The present invention will be better understood and its various objects and advantages will be more fully appreciated from the following description taken in conjunction with the accompanying drawings, in which.

DETAILED DESCRIPTION OF THE PREFERRED EMBODIMENT

Hereinafter, the present invention will be described in detail with reference to the accompanying drawings.

Figure 1:
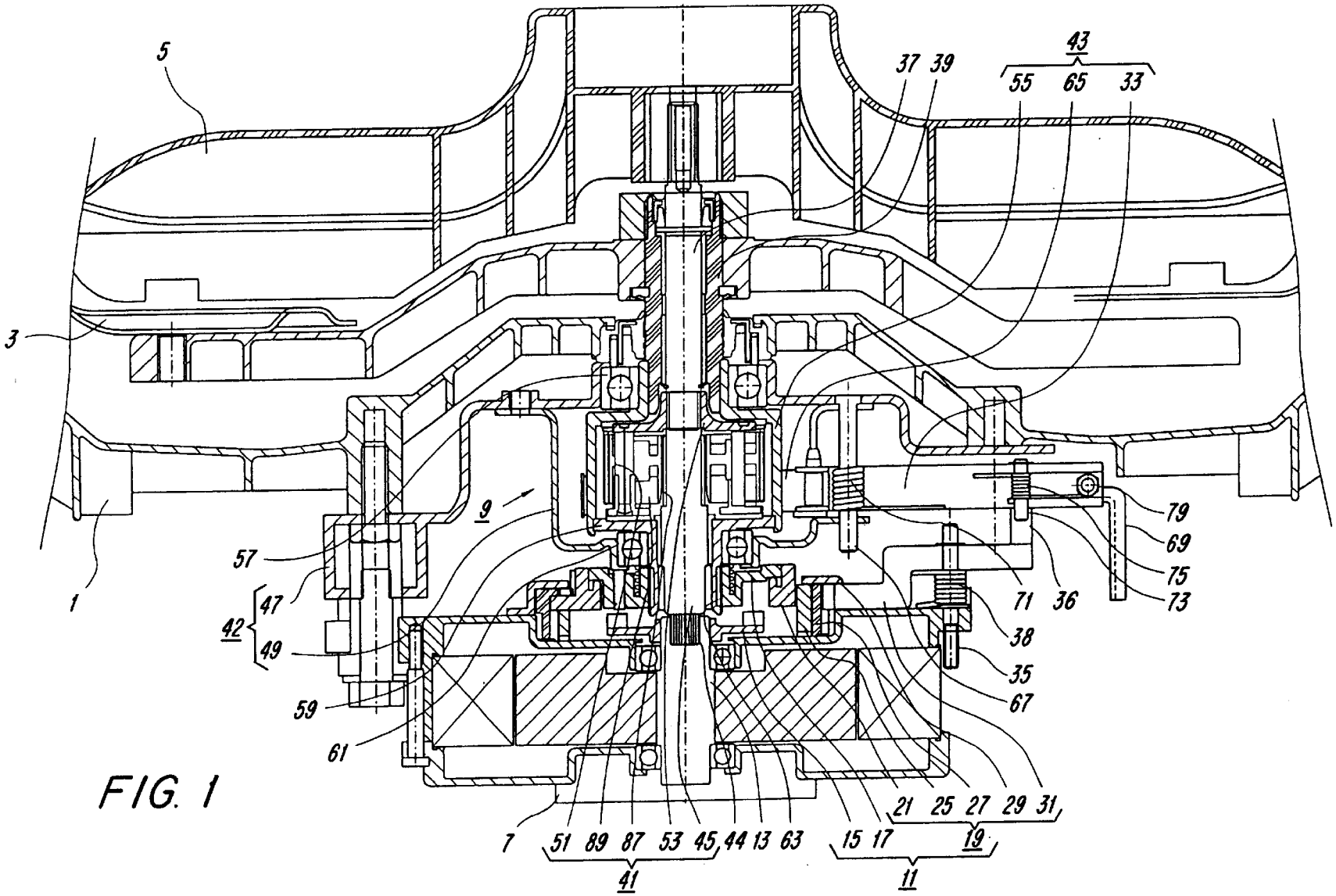
FIG. 1 is a partial sectional view of a washing machine having a brake assembly according to the present invention.

FIG. 1 is a partial sectional view of a washing machine having a brake assembly according to the present invention.

A washing machine has an outer tub 1 suspended in a casing, a spin basket 3 rotatably installed in the outer tub 1, and a pulsator 5 installed in the spin basket 3. A driving motor 7 is installed under the outer tub 1. Between the outer tub 1 and the driving motor 7, a shaft assembly 9 for transmitting the driving force of the driving motor 7 to the pulsator 5 and the spin basket 3, and a clutch assembly 11 for controlling the transmission of the driving force of the driving motor 7 to the shaft assembly 9 are installed.

The clutch assembly 11 is comprised of a lower clutch 15 into which a motor shaft 13 is inserted by force, an upper clutch 17 engaged with, or disengaged from, the lower clutch 15, and a clutch guide device 19 for engaging the upper clutch 17 with, or disengaging the upper clutch 17 from, the lower clutch 15, by moving the upper clutch 17 along the motor shaft 13.

The clutch guide device 19 is comprised of a clutch guide 21 assembled with the upper clutch 17, a cam 25 for guiding the clutch guide 21 toward the upward and downward directions, a cam gear 27 for rotating the clutch guide 21, a housing 29 encompassing them and fixed on an upper side of the driving motor 7, and a lever gear 31 engaged with the cam gear 27 so as to rotate the cam gear 27. A lever shaft 35 fixed on the driving motor 7 is installed on the lever gear 31, by which the lever gear 31 can pivot about the lever shaft 35. A lever link 36 protrudes upward at an end of the lever gear 31. When a brake lever 33 (which will be described later in detail) pivots, the lever link 36 is contact with the brake lever 33, and thereby the lever gear 31 pivots about the lever shaft 35. A lever spring 38 for returning the lever gear 31 is installed on the lever shaft 35.

The shaft assembly 9 is comprised of a hollow spin basket shaft 39 connected to the spin basket 3, a pulsator shaft 37 disposed in the spin basket shaft 39 coaxially therewith and connected to the pulsator 5, a gear assembly 41 for reducing the rotational velocity of the driving motor 7 and transmitting it to the pulsator 5 during a washing operation or a rinsing operation, an outer casing 42 for encompassing them, and a brake assembly 43 for controlling the rotation of the spin basket shaft 39. The outer casing 42 is comprised of an upper casing 47 and a lower casing 49.

The gear assembly 41 is comprised of a connection shaft 45 assembled with the motor shaft 13 by a serration 44 so as to be capable of rotating together therewith, a sun gear 87 assembled with the upper portion of the connection shaft 45, a plurality of planet gears 89 disposed around the sun gear 87 and revolving around the sun gear 87 while the sun gear 87 is rotating, a ring gear 51 engaged with the planet gears 89, and a carrier 53 connected to respective axes of the planet gears 89 and assembled with the pulsator shaft 37.

FIGS. 2 through 5 show the brake assembly 43 according to the present invention.

The brake assembly 43 is comprised of a cylindrical brake drum 55 assembled with the outer periphery of the ring gear 51 so as to surround the outer area of the gear assembly 41 and assembled with the spin basket shaft 39 at the upper portion thereof, a brake band 65 installed on an outer side of the brake drum 55 so as to control the rotation of the brake drum 55, and a brake lever 33 for operating the brake band 65 so as to be contacted with and distanced from the periphery of the brake drum 55. One end of the brake band 65 is assembled with the lower casing 49 of the shaft assembly 9, and the other end thereof is fixed to the brake lever 33 by a fixing pin 95.

A brake lever shaft 67 in parallel with the rotational axis of the brake drum 55 is installed on the brake lever 33, and a brake link 69 is installed on the end of the brake lever 33. The brake lever shaft 67 is fixed on the upper casing 47 and lower casing 49 of the shaft assembly 9, and a brake spring 71 for applying an elastic force to the brake lever 33 is installed on the brake lever shaft 67.

Figure 5:
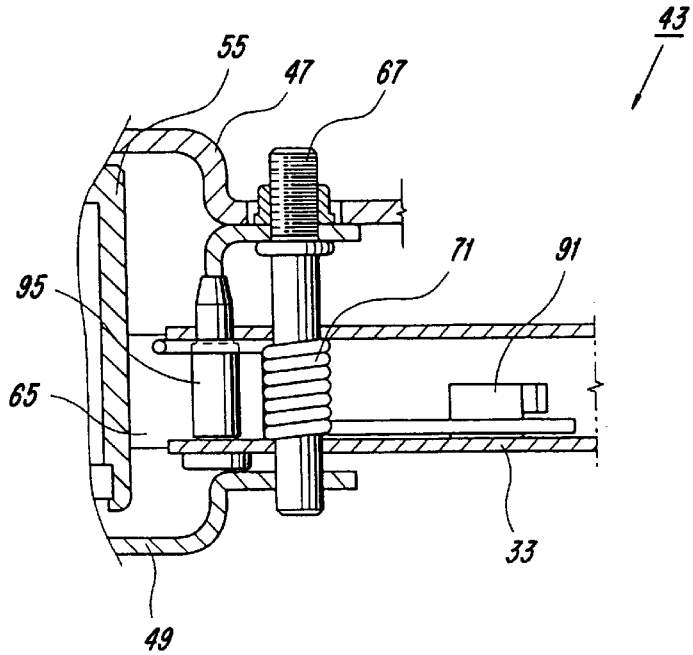
FIG. 5 is a partial enlarged view of the brake assembly shown in FIG. 1.
Figure 6:
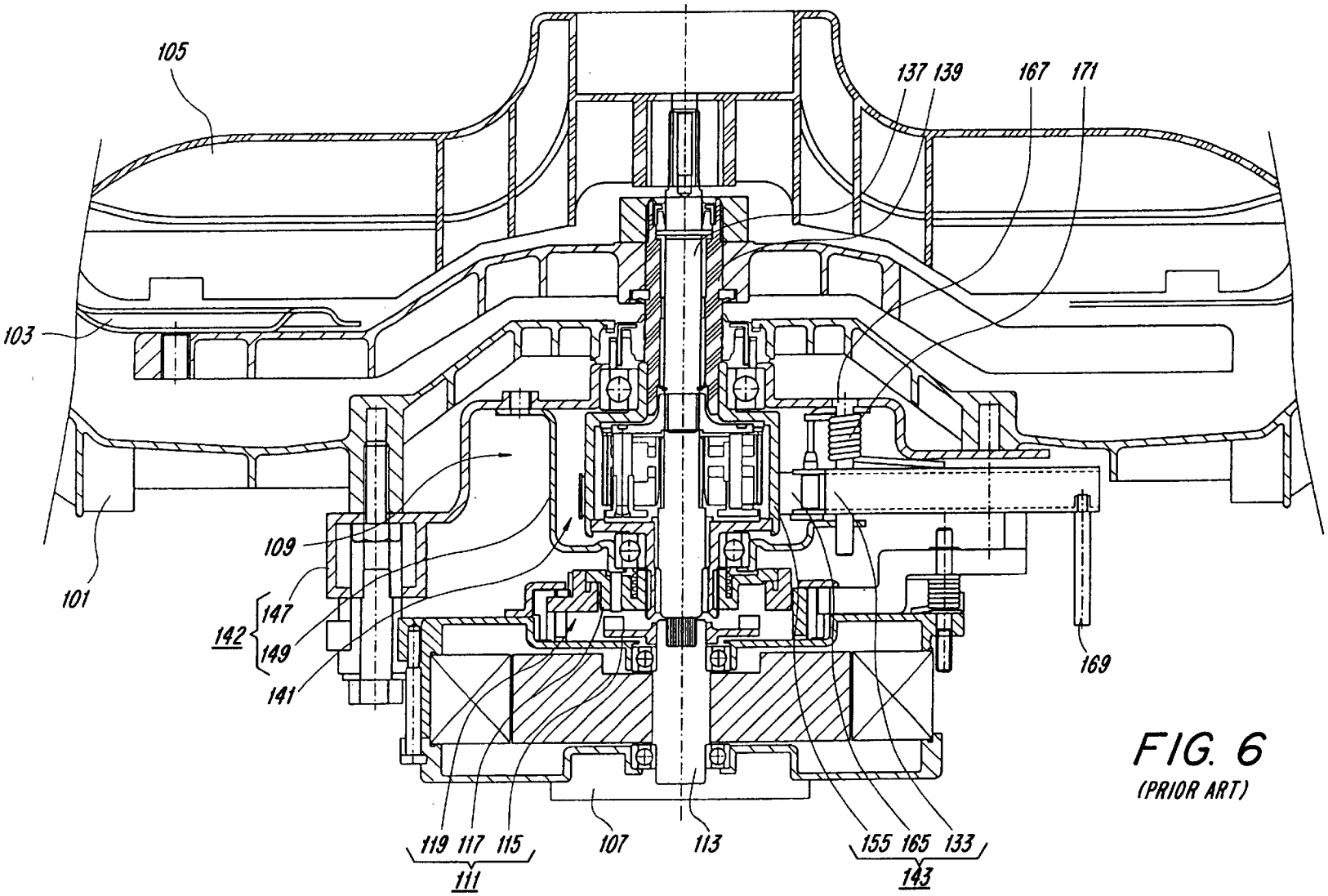
FIG. 6 (PRIOR ART)
FIG. 6 is a partial sectional view of a conventional washing machine.
Figure 7:
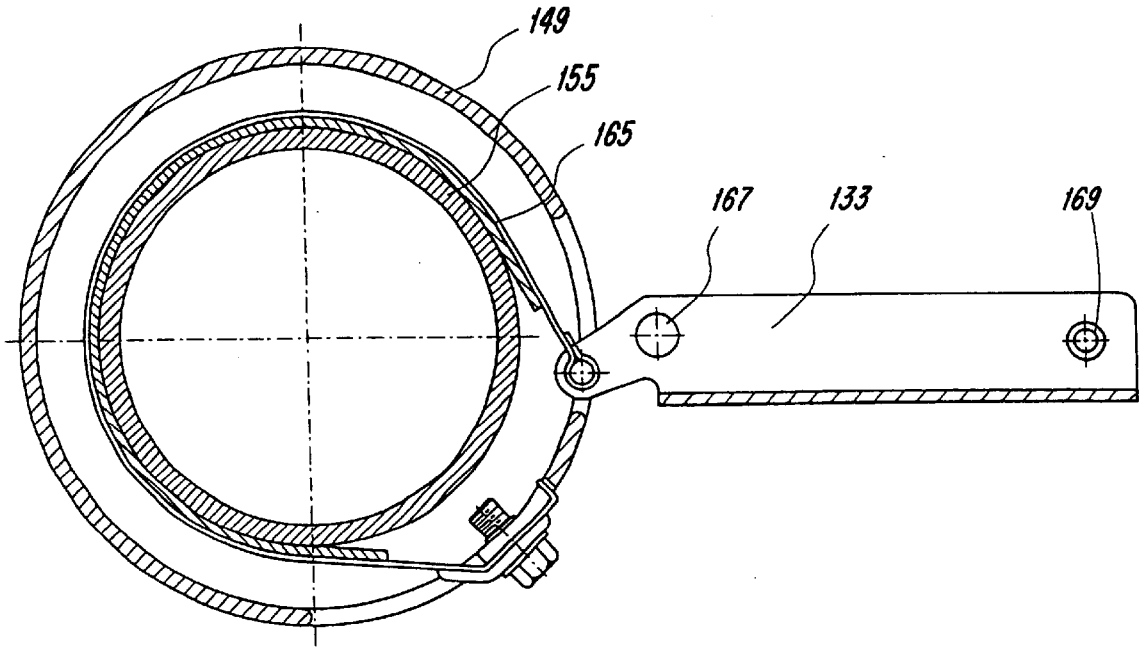
FIG. 7 (PRIOR ART)
FIG. 7 is an enlarged transverse sectional view of a brake assembly shown in FIG. 6.

As shown in FIG. 5, the brake spring 71 is a torsion spring, and is disposed within the width of the brake lever 33, that is, within the height of the brake lever 33. One end of the brake spring 71 is fixedly hooked by the hooking part 91 provided on the brake lever 33, and the other end thereof is fixed on the lower casing 49.

Figure 2:
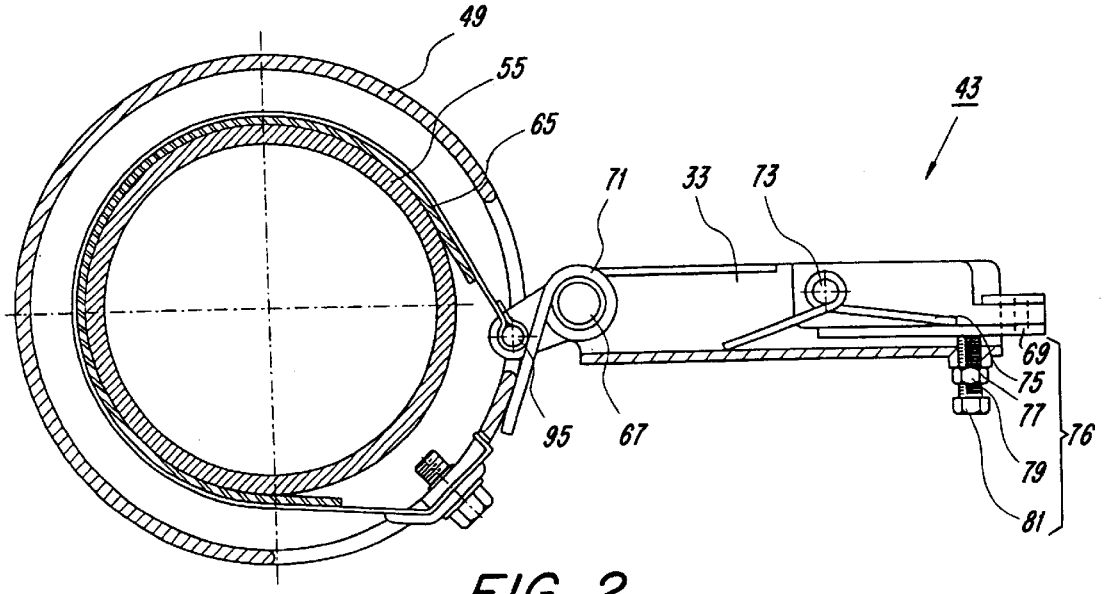
FIG. 2 is an enlarged transverse sectional view of the brake assembly shown in FIG. 1.
Figure 3:
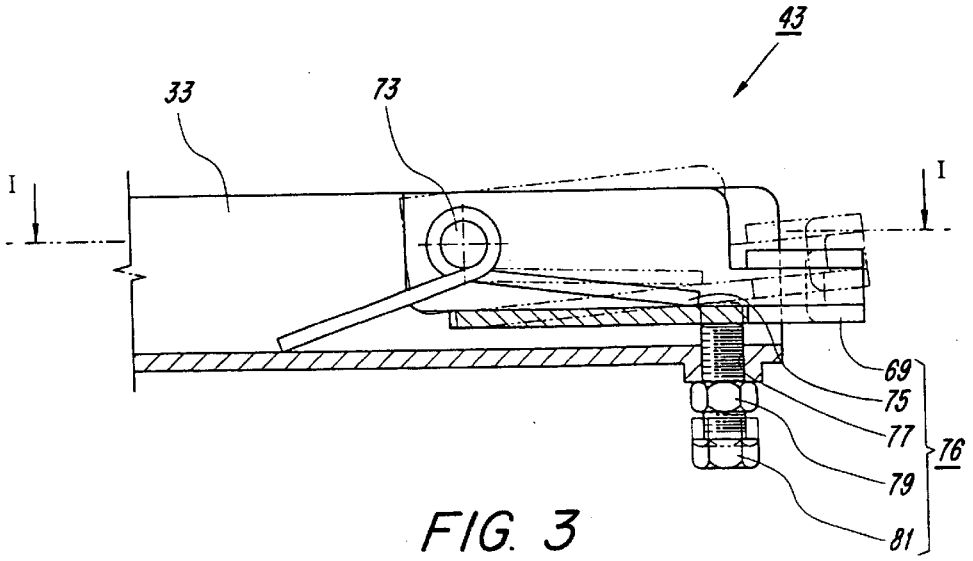
FIG. 3 is a partial enlarged view of FIG. 2.
Figure 4:
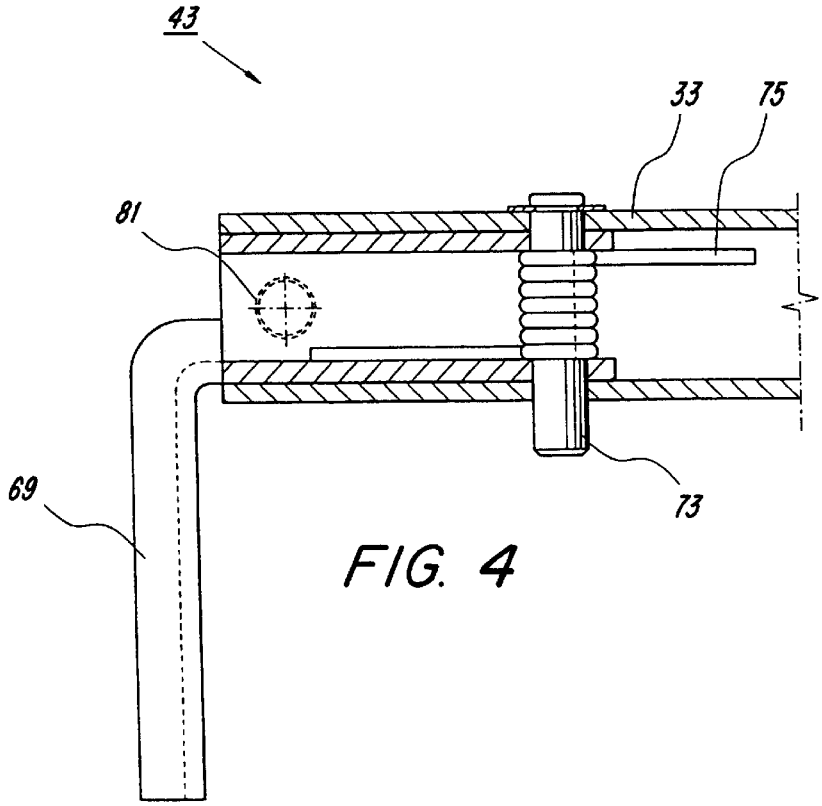
FIG. 4 is a sectional view of FIG. 3 taken along the line I—I.

As shown in FIGS. 2 through 4, a device 76 for adjusting the pivoting position of the brake lever 33 is installed on the free end area of the brake lever 33.

The adjusting device 76 is comprised of a brake link 69 installed on the brake lever 33 by a pivoting pin 73 in parallel with the brake lever shaft 67 so as to be capable of pivoting, a screw assembly part 77 formed on a side of the brake lever 33, an adjusting bolt 81 screwed to the screw assembly part 77, of which screwed end is contacted with the side of the brake link 69, and a link spring 75 is installed on the pivoting pin 73. The link spring 75 is a torsion spring like the brake spring 71.

One end of the link spring 75 is contacted with the inner side of the brake lever 33, and the other end thereof is contacted with the side of the brake link 69. Therefore, the link spring 75 elastically pushes the brake link 69 so that the brake link 69 is maintained to be in contact with the screwed end of the adjusting bolt 81. Meanwhile, a nut 79 is disposed between the adjusting bolt 81 and the screw assembly part 77. The nut 79 prevents the adjusting bolt 81 from being released.

Meanwhile, the free end of the brake link 69 is connected to a drain motor (not shown). The drain motor functions to open/close a drain valve (not shown). When the drain motor operates, that is, when the washing machine performs a draining operation or a dehydrating operation, the drain motor opens the drain valve, and simultaneously, the link spring 75 is pulled out by the drain motor. Accordingly, the brake link 69 and the brake lever 33 are pivoted, and thereby, the brake drum 55 is released from the brake band 65.

Hereinbelow, the operation of the brake assembly for use in a washing machine according to the present invention will be described.

During the washing or rinsing operations, the brake lever 33 pulls the brake band 65 with the elastic force of the brake spring 71, and thereby, the brake band 65 is contacted with the brake drum 55. Therefore, the rotation of the brake drum 55 is braked by the brake band 65. In this situation, the upper clutch 17 is disengaged from the lower clutch 15.

As the driving motor 7 operates to rotate the motor shaft 13, the connection shaft 45 assembled with the motor shaft 13 rotates. The rotational velocity of the connection shaft 45 is reduced by the sun gear 87 and the planet gear 89, and therefore, the pulsator shaft 37 and the pulsator 5 are rotated together at a reduced rotational velocity. A vortex water flow is generated in the spin basket 3 by the rotating pulsator 5, and thereby, the washing and rinsing operations are performed.

During a dehydrating operation, the drain valve is opened by the drain motor, and at the same time the brake lever 33 is pulled out by the drain motor, whereby the brake lever 33 pivots about the brake lever shaft 67. Therefore, the brake band 65 is distanced from the brake drum 55, and the brake drum 55 is released so as to be capable of rotating.

While the brake lever 3 is pivoting, the lever link 36 contacted with the brake 33 pivots about the lever shaft 35 so as to rotate the cam gear 27 engaged with the lever gear 31. As the cam gear 27 is rotated, the clutch guide 21 is moved down, with being rotated by the cam gear 27 and the cam 25. Accordingly, the upper clutch 17 is moved down and is engaged with the lower clutch 15.

As the driving motor 7 operates to rotate the motor shaft 13, the upper clutch 17 engaged with the lower clutch 15 is rotated, and thereby, all of the ring gear 51, the brake drum 55, the spin basket shaft 39, and the pulsator shaft 37 are rotated. Therefore, the pulsator 5 and the spin basket 3 are rotated at the same speed as the rotational speed of the motor shaft 13, and the laundry accommodated in the spin basket 3 is dehydrated by the centrifugal force generated in such a situation.

When the dehydrating operation ends, the driving motor 7 stops operating, and the drain motor releases the brake link 69. Therefore, the brake lever 33 is recovered as hereto by the brake spring 71, and the brake drum 55 is braked again by the brake band 65. Furthermore, when the brake lever 33 is returned, the lever gear 31 is returned to its original position by the lever spring 38 installed on the lever shaft 35, and thereby, the upper clutch 17 is moved upward so as to be disengaged from the lower clutch 15.

As described above, in order to change the driving mode of the shaft assembly 9 according to the operational mode, that is, the washing, rinsing, or dehydrating operations, the brake assembly 43 brakes or releases the brake drum 55. For the stable operation of the brake assembly 43, the release of the brake band 65 should be performed exactly. If an error is generated by an assembly tolerance of the brake assembly 43, or an abrasion of the brake band 65 occurs after the washing machine has been used for a long period of time, then the position of the brake lever 33 may be changed; in such a situation, the error can be amended using the adjusting bolt 81.

That is, if the adjusting bolt 81 is screwed deeply into the screw assembly part 77, as shown in FIG. 3 with dotted lines, the brake link 69 is pivoted about the pivoting pin 73 against the elastic force of the link spring 75. Likewise, if the adjusting bolt 81 is revolved so as to be released from the screw assembly part 77, the brake link 69 is pivoted in the opposite direction by the elastic force of the link spring 75.

After the brake assembly 43 is completely assembled, the pivoting position of the brake link 69 is adjusted with the adjusting bolt 81. Thus, if the pivoting of the brake lever 33 is insufficiently performed by the drain motor due to the assembly tolerance, the error of the braking operation can be amended by screwing the adjusting bolt 81 deeply into the screw assembly part 77. Furthermore, if the position of the brake lever 33 is changed by the abrasion of the brake band 65, the error can also be amended using the adjusting bolt 81. Therefore, the brake band 65 need not be changed with a new one.

Unlike the conventional brake assembly of a washing machine, in the brake assembly 43 according to the present invention, the brake spring 71 is not disposed between the brake lever 33 and the upper casing 47, but is disposed at a position whose height is identical to that of the brake lever 33, so the height of the shaft assembly 9 can be reduced.

Furthermore, in order to assemble the brake assembly 43, the brake band 65 is firstly fixed on an end of the brake lever 33 with the fixing pin 95, and the brake spring 71 is secondly assembled on the inner side of the brake lever 33 so as to wind around the brake lever shaft 67. Then, the brake lever shaft 67 is assembled to the upper casing 47 and the lower casing 49 of the shaft assembly 9. According to such a process, the brake assembly 43 can be manufactured easily.

As described above, according to the present invention, even when an assembly tolerance or an abrasion of the brake band 65 occurs, the error of the braking operation can be amended easily, and therefore, the brake assembly 43 can operate in a stable manner. Furthermore, it is easy to assemble the brake assembly 43.

Although the present invention has been described and illustrated in detail, it is clearly understood that the same is by way of illustration and example only and is not to be taken by way of limitation, wherein the spirit and scope of the present invention is limited only by the terms of the appended claims.

What is claimed is:

1. A brake assembly of a washing machine, comprising:

a brake drum rotating together with a spin basket;

a brake band disposed on an outer side of the brake drum;

a brake lever of which one end is fixed to the brake band, the brake lever arranged for driving the brake band so that the brake band is contacted with, or distanced from, the brake drum according to a pivoting position thereof;

a brake spring for elastically pushing the brake lever in a pivoting direction thereof;

a brake link installed on the other end of the brake lever so as to be capable of pivoting about a pivoting axis in parallel with a pivoting axis of the brake lever; and adjusting means for adjusting a relative pivoting position of the brake link with respect to the brake lever, the adjusting means comprising:

a link spring for elastically pushing the brake link in a pivoting direction thereof; and a bolt screwed to the brake lever so that a screwed end thereof is contacted with the brake link against an elastic force of the link spring, the bolt adjusted for adjusting a relative pivoting position of the brake link with respect to the brake lever according to a screwed position thereof.

2. The brake assembly as claimed in claim 1, further comprising a nut disposed between the bolt and the brake lever, the nut for preventing the bolt being released.

3. The brake assembly as claimed in claim 1, wherein the brake spring is a torsion spring.

4. The brake assembly as claimed in claim 3, wherein the brake spring is disposed within a width of the brake lever.

* * * * *